US008614038B2

(12) United States Patent
Yu et al.

(10) Patent No.: US 8,614,038 B2
(45) Date of Patent: Dec. 24, 2013

(54) PLASTICIZED ANTI-CURL BACK COATING FOR FLEXIBLE IMAGING MEMBER

(75) Inventors: Robert C. U. Yu, Webster, NY (US); Edward F. Grabowski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 136 days.

(21) Appl. No.: 13/366,592

(22) Filed: Feb. 6, 2012

(65) Prior Publication Data

US 2013/0202995 A1 Aug. 8, 2013

(51) Int. Cl.
*G03G 5/10* (2006.01)

(52) U.S. Cl.
USPC ..... 430/58.05; 430/56; 430/59.6

(58) Field of Classification Search
USPC ..... 430/56, 58.05, 930, 59.6
See application file for complete search history.

(56) References Cited

U.S. PATENT DOCUMENTS

| | | | | |
|---|---|---|---|---|
| 3,121,006 | A | 2/1964 | Middleton et al. | |
| 4,286,033 | A | 8/1981 | Neyhart et al. | |
| 4,291,110 | A | 9/1981 | Lee | |
| 4,338,387 | A | 7/1982 | Hewitt | |
| 4,464,450 | A | 8/1984 | Teuscher | |
| 4,587,189 | A | 5/1986 | Hor et al. | |
| 4,664,995 | A | 5/1987 | Horgan et al. | |
| 4,921,773 | A | 5/1990 | Melnyk et al. | |
| 5,069,993 | A | 12/1991 | Robinette et al. | |
| 5,153,094 | A | 10/1992 | Kazmaier et al. | |
| 5,166,339 | A | 11/1992 | Duff et al. | |
| 5,189,155 | A | 2/1993 | Mayo et al. | |
| 5,189,156 | A | 2/1993 | Mayo et al. | |
| 5,382,486 | A | 1/1995 | Yu et al. | |
| 5,756,245 | A | 5/1998 | Esteghamatian et al. | |
| 6,183,921 | B1 * | 2/2001 | Yu et al. | 430/58.7 |
| 7,166,399 | B2 | 1/2007 | Carmichael et al. | |
| 7,455,941 | B2 | 11/2008 | Evans et al. | |
| 7,462,434 | B2 | 12/2008 | Yu et al. | |
| 8,003,285 | B2 * | 8/2011 | Yu et al. | 430/58.05 |
| 2010/0279217 | A1 * | 11/2010 | Yu et al. | 430/58.8 |
| 2010/0279219 | A1 | 11/2010 | Yu et al. | |

* cited by examiner

*Primary Examiner* — Christopher Rodee
(74) *Attorney, Agent, or Firm* — Pillsbury Winthrop Shaw Pittman LLP

(57) ABSTRACT

The presently disclosed embodiments relate generally to a flexible imaging member having an anti-curl back coating comprising a liquid plasticizer, and the imaging member is substantially flat.

22 Claims, 2 Drawing Sheets

PLASTICIZED ANTI-CURL BACK COATING FOR FLEXIBLE IMAGING MEMBER

BACKGROUND

The presently disclosed embodiments relate generally to the formulation of a layer that provides overall flatness or substantial flatness to flexible imaging members and components for use in electrostatographic apparatuses. More particularly, the embodiments pertain to a flexible electrophotographic imaging member belt prepared to include an anti-curl back coating formulated to comprise a mechanically robust copolymer binder that does have enhanced wear resistance and improved imaging member curl control.

Flexible electrostatographic imaging members are well known in the art. Typical flexible electrostatographic imaging members include, for example: (1) electrophotographic imaging members (photoreceptors) commonly utilized in electrophotographic (xerographic) processing systems; (2) electroreceptors such as ionographic imaging members for electrographic imaging systems; and (3) intermediate toner image transfer members such as an intermediate toner image transferring member which is used to remove the toner images from a photoreceptor surface and then transfer the very images onto a receiving paper.

The electrostatographic imaging members are known to be in two distinctive configurations, for example, in flexible and in rigid configurations. The flexible electrostatographic imaging members may either be seamless or seamed belts. A seamed belt is usually formed by cutting a rectangular imaging member sheet from a web stock, overlapping a pair of opposite ends, and welding the overlapped ends together to form a welded seam belt. Typical electrophotographic imaging member belts that include a charge transport layer and a charge generating layer on one side of a supporting substrate layer exhibit undesirable upward curling. Thus, an anti-curl back coating is usually coated onto the opposite side of the substrate layer to render imaging member belts flatness. A typical electrographic imaging member belt includes a dielectric imaging layer on one side of a supporting substrate. An anti-curl back coating is often needed on the opposite side of the substrate for curl control and render desired flatness. However, since the rigid electrostatographic imaging members utilize a rigid substrate support, no anti-curl back coating is needed for curl control.

In electrophotography, also known as xerography, electrophotographic imaging or electrostatographic imaging, the surface of an electrophotographic plate, drum, belt or the like containing a photoconductive insulating layer on a conductive layer is first uniformly electrostatically charged. The imaging member is then exposed to a pattern of activating electromagnetic radiation, such as light. Charge generated by the photoactive pigment moves under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Known electrophotographic imaging members belts either include an anti-curl back coating or a structurally simplified curl-free design without an anti-curl back coating have been successfully developed and improved to give encouraging result. Yet, such electrophotographic imaging members comprise a top outermost exposed ground strip layer (co-coated adjacent to the charge transport layer to effect electrical connectivity between the photo-electrically active layers in the members) that exhibits deficiencies and shortfalls which are undesirable in advanced automatic, cyclic electrophotographic imaging copiers, duplicators, and printers.

Therefore, there is a need to provide an ACBC formulation which has robust physical and mechanical function to effect substrate protection. More specifically, the need includes providing the imaging member with an exposed ACBC formulation having improvements of reduction in surface contact friction, less susceptibility to scratch/wear failure to effect service life extension, and as well as rendering the prepared imaging member with absolute flatness without creating other undesirable problems. To achieve this purpose, flexible imaging members in various embodiments of present disclosure are prepared to have a plasticized CTL, include an ACBC designed to have reformulation comprising a film forming polycarbonate, liquid plasticizer, adhesion promoter, and particles dispersion in its material matrix.

SUMMARY

According to aspects illustrated herein, there is provided a flexible imaging member comprising a substrate; a charge generating layer disposed on the substrate; a charge transport layer disposed on the charge generating layer; and an anti-curl back coating disposed on the substrate on a side opposite to the charge transport layer, the anti-curl back coating comprises a polycarbonate, and a liquid plasticizer. In embodiments, the flexible imaging member is substantially flat.

In another embodiment, there is provided a flexible imaging member comprising a substrate; a charge generating layer disposed on the substrate; a charge transport layer disposed on the charge generating layer; and an anti-curl back coating disposed on the substrate on a side opposite to the charge transport layer, the anti-curl back coating comprises a polycarbonate, a copolyester adhesion promoter, and a liquid plasticizer having the following formula:

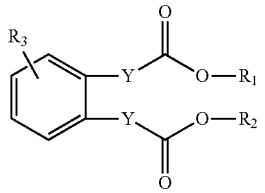

wherein Y is O or null; each $R_1$ and $R_2$ is independently $C_1$-$C_6$ alkyl or $R_1$ and $R_2$ taken together with the O atom of the ester groups to which they are attached and part of the benzene ring form a heterocyclic ring; $R_3$ is H or —C(O)$OR_4$; and $R_4$ is $C_1$-$C_6$ alkyl.

In another embodiment, there is provided a substantially flat flexible imaging member comprising a substrate; a charge generating layer disposed on the substrate; a charge transport layer disposed on the charge generating layer, the charge transport layer comprises a polycarbonate binder, a charge transport compound of N,N'-diphenyl-N,N'-bis(3-methylphenyl)-1,1'-biphenyl-4,4'-diamine, and a liquid plasticizer; and an anti-curl back coating disposed on the substrate on a side opposite to the charge transport layer, the anti-curl back coating comprises a polycarbonate, a copolyester adhesion promoter, an organic or inorganic particle or mixtures thereof, and a liquid plasticizer, wherein the substantially flat flexible imaging member exhibits an upward curling of at least equals to or greater than 14 inches in diameter of curvature.

BRIEF DESCRIPTION OF THE DRAWINGS

For a better understanding, reference may be made to the accompanying figures. The figures demonstrate cross-sectional views of a negatively charged multiple layered electrophotographic imaging member in a flexible belt configuration comprising an improved anti-curl back coating layer prepared to have the material compositions re-formulated according to the description detailed in the present disclosure embodiments. The following is a brief description of the drawings, which are presented for the purposes of illustrating the exemplary embodiments disclosed herein and not for the purposes of limiting the same.

DETAILED DESCRIPTION

Figure 1:
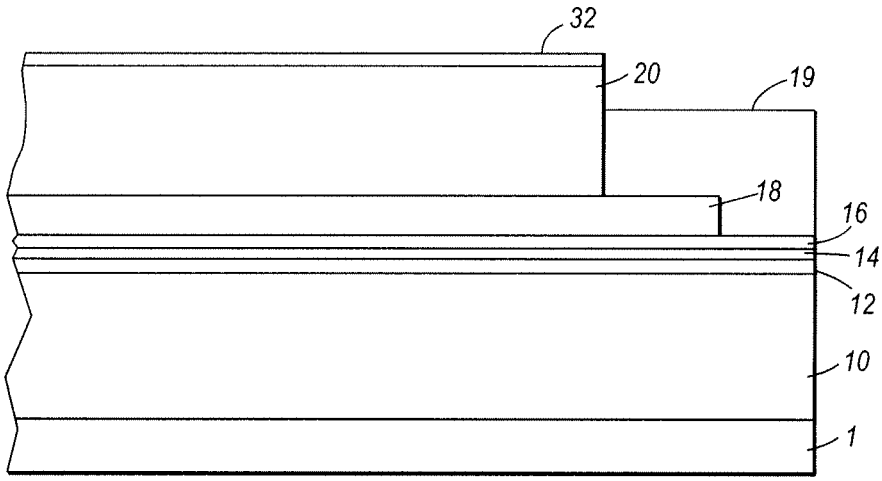
FIG. 1 is a schematic cross-sectional view of a first exemplary embodiment of a flexible imaging member having an anti-curl back coating prepared according to the description of present disclosure.

In the following description, reference is made to the accompanying drawings, which form a part hereof and which illustrate the exemplary embodiments of the present disclosure herein and not for the purpose of limiting the same. It is also understood that other embodiments may be utilized and structural and operational changes may be made without departure from the scope of the present disclosure.

The flexible electrophotographic imaging member belts include a photoconductive layer having a single layer or composite layers that are applied over a flexible substrate support, so they exhibit undesirable upward imaging member curling. To offset and control the curl for rendering the imaging member with appropriate flatness, an anti-curl back coating is required to be coated onto the back side of the substrate support.

An anti-curl back coating layer is typically required to balance the inward pulling force for curl elimination. The anti-curl back coating layer should have optically suitable transmittance (e.g., good transparency), so that the photoreceptor can be erased by radiation directed from the backside of the belt during electrophotographic imaging processes. Furthermore, as the imaging member belt is encircled around and supported by a number of belt module rollers and backer bars, the anti-curl back coating layer should also be mechanically robust to provide adequate wear resistance to withstand the frictional action against these belt module support components, under a dynamic belt cyclic machine functioning condition in the field.

During the manufacturing process of flexible imaging members, the charge transport layer (CTL) is coated over the charge generation layer (CGL) by applying a CTL solution coating on top of the CGL, then subsequently drying the wet applied CTL coating at elevated temperatures of about 120° C., and finally cooling down the coated photoreceptor to the ambient room temperature of about 25° C. Due to the thermal contraction mismatch between the CTL and the substrate support, the processed photoreceptor web (with finished CTL coating obtained through drying/cooling process) spontaneous curls upwardly into a roll. For example, a photoreceptor web having a 29-micrometer CTL thickness and a 3½ mil polyethylene naphthalate substrate may spontaneously curl-up into a 1½-inch roll.

Typically, the CTL in a photoreceptor device has a coefficient of thermal contraction of from about 3 to about 4 times, or approximately 3.7 times, greater than that of the flexible substrate support. As a result, the CTL has a larger dimensional shrinkage than that of the flexible substrate support after through the process of application of wet CTL coating, drying it at elevated temperature, and the eventual photoreceptor web cools down to the ambient room temperature. The exhibition of photoreceptor web curling up after the completion of CTL coating is due to the consequence of larger CTL contraction as a result of the heating/cooling cycles of the manufacturing processing step. Without being bounded by theory, the development of the upward curling may be explained by the following mechanisms: (1) while the photoreceptor web after application of wet CTL coating is dried at elevated temperature (120° C.), the solvent(s) of the CTL coating solution evaporates leaving a viscous free flowing CTL liquid where the CTL releases internal stress, and maintains its lateral dimension stability without causing the occurrence of dimensional contraction; (2) during the cool down period, the temperature falls and reaches the glass transition temperature (Tg) of the CTL at 85° C., the CTL instantaneously solidifies and adheres to the underneath CGL as it transforms from being a viscous liquid into a solid layer; (3) as the temperature drops from 85° C. down to the 25° C. room ambient, the solid CTL of the photoreceptor web laterally contracts more than the flexible substrate support due to the higher thermal coefficient of dimensional contraction than that of the substrate support. Such differential in dimensional contraction results in tension strain built-up in the CTL, which pulls the photoreceptor web upwardly to exhibit curling. Therefore, an anti-curl back coating (ACBC) is applied to the backside of the substrate to balance the curl and render desirable imaging member flatness, In recent development, attempts to overcome the shortcomings associated with the ACBC function, flexible electrophotographic imaging member belts have been successfully re-designed to give a structurally simplified configuration to give flatness without the need of an ACBC. In these structurally simplified imaging belts, incorporation of a high boiler liquid plasticizer into the top outermost exposed CTL of the negatively charge imaging member belt helps provide the reduction/elimination of dimensional contraction differential between the CTL and the flexible substrate support which relieves the internal strain build-up in the CTL to suppress the curl-up tension stress. Similarly, the ground strip layer likewise incorporates a plasticizer as described in the CTL to supplement the resulting imaging member curl control.

The disclosure provides a conventional flexible multiple layered electrophotographic imaging member, having an optional top outermost protective overcoat layer, a charge transport layer (CTL) over a charge generation layer (CGL), a flexible supporting substrate, and an anti-curl back coating (ACBC) layer prepared according to the re-formulated compositions described in the present disclosure. The flexible multiple layered electrophotographic imaging member of this configuration is a negatively charged imaging member belt.

The exemplary embodiments of this disclosure are further described below with reference to the accompanying figures. The specific terms are used in the following description for clarity, selected for illustration in the drawings and not to define or limit the scope of the disclosure. The structures in the figures are not drawn according to their relative proportions and the drawings should not be interpreted as limiting the disclosure in size, relative size, or location. In addition, though the discussion will address negatively charged systems, the imaging members of the present disclosure may also included material compositions designed to be used in positively charged systems. Also the term "photoreceptor" or "photoconductor" or photosensitive member is generally used interchangeably with the terms "imaging member." The term "electrostatographic" includes "electrophotographic" and "xerographic." The terms "charge transport molecule" are generally used interchangeably with the terms "hole transport molecule."

The term "flatness" or "substantially flatness" or "nearly flat" refers to a flexible imaging member, comprising the plasticized layer(s) prepared according to present disclosure, exhibits an upward curling of at least equals to or greater than 14 inches in diameter of curvature, since this magnitude of curling will be totally eliminated/flattened as the flexible imaging member belt is mounted to encircle a machine belt support module and under a one pound per inch belt width tension.

FIG. 1 illustrates an exemplary embodiment of a negatively charged multi-layered flexible electrophotographic imaging member. Specifically, shows a flexible multiple layered electrophotographic imaging member comprising an ACBC 1, a substrate 10, an optional a conductive layer 12, an optional hole blocking layer 14 over the optional conductive layer 12, and an optional adhesive layer 16 over the blocking layer 14, a charge generating layer (CGL) 18, a charge transport layer (CTL) 20, an optional ground strip layer 19 operatively connects the CGL 18 and the CTL 20 to the optional conductive layer 12, and an optional over coat layer 32. A ground strip layer 19 may be included to effect electrical continuity. The optional overcoat layer 32 may be included to provide abrasion/wear protection for the CTL 20. Typically, the ACBC layer 1, being the outermost bottom layer, is to be applied onto the backside of substrate 10, opposite to the electrically active layers, for impacting imaging member curl control and provide substrate 10 protections against scratch/wear failure.

Embodiments of present disclosure are directed generally to an improved flexible imaging member, particularly the flexible multiple layered electrophotographic imaging member or photoreceptor, in which the ACBC is formulated to have improve mechanical function, effect best curl control, and render desirable imaging member flatness. The ACBC of present disclosure is a formulation by utilizing a high molecular weight film forming copolymer binder.

Referring back to FIG. 1, an embodiment of a negatively charged flexible multiple layered electrophotographic imaging member having a belt configuration is shown. As can be seen, the belt configuration is provided with an anti-curl back coating (ACBC) 1, a supporting substrate 10, an electrically conductive ground plane 12, a hole blocking layer 14, an adhesive layer 16, a charge generation layer (CGL) 18, and a charge transport layer (CTL) 20. An optional overcoat layer 32 and ground strip 19 may also be included. An exemplary photoreceptor having a belt configuration is disclosed in U.S. Pat. No. 5,069,993, which is hereby incorporated by reference. U.S. Pat. Nos. 7,462,434; 7,455,941; 7,166,399; and 5,382,486 further disclose exemplary photoreceptors and photoreceptor layers such as a conductive ACBC layer.

Although the formation and coating of the CGL 18 and the CTL 20 of the negatively charged imaging member described and shown in all the four the figures here has two separate layers, nonetheless it will also be appreciated that the functional components of these two layers may however be combined and formulated into a single layer to give a structurally simplified imaging member. Alternatively, the CGL 18 may also be disposed on top of the CTL 20, so the imaging member as prepared is therefore converted into a positively charge imaging member.

The Substrate

The imaging member support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate (PET) from DuPont, or polyethylene naphthalate (PEN) available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of different configurations, such as for example, a plate, a cylinder, a drum, a scroll, an endless flexible belt, and the like. In the case of the substrate being in the form of a belt, as shown in the figures, the belt can be seamed or seamless. In certain embodiments, the photoreceptor is rigid. In certain embodiments, the photoreceptor is in a drum configuration.

The thickness of the substrate 10 of a flexible belt depends on numerous factors, including flexibility, mechanical performance, and economic considerations. The thickness of the flexible support substrate 10 of the present embodiments may be from 1.0 to about 7.0 mils; or from about 2.0 to about 5.0 mils.

The substrate support 10 is not soluble in the solvents used in each of the coating layer solutions. The substrate support 10 is optically transparent or semi-transparent. The substrate support 10 remains physical/mechanical stable at temperature below about 170° C. Therefore, at or below 170° C. the substrate support 10, below which temperature, may have a thermal contraction coefficient ranging from about $1\times10^{-5}$/° C. to about $3\times10^{-5}$/° C. and a Young's Modulus of between about $5\times10^5$ psi ($3.5\times10^4$ Kg/cm$^2$) and about $7\times10^5$ psi ($4.9\times10^4$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer is from about 20 Angstroms to about 750 Angstroms, or from about 50 Angstroms to about 200 Angstroms, for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer 12, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,338,387, 4,286,033 and 4,291,110.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Adhesive Layer

An optional separate adhesive interface layer 16 may be provided in certain configurations, such as, for example, in flexible web configurations. In the embodiment illustrated in the Figure, the interface layer 16 would be situated between the blocking layer 14 and the CGL 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik Inc., 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of at least about 0.01 micrometer, and no more than about 900 micrometers after drying. In certain embodiments, the dried thickness is from about 0.03 micrometer to about 1.00 micrometer, or from about 0.05 micrometer to about 0.50 micrometer.

The Ground Strip Layer

The ground strip layer 19 may comprise a film-forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer 19 may have a thickness of from about 7 micrometers to about 42 micrometers, from about 14 micrometers to about 27 micrometers, or from about 17 micrometers to about 22 micrometers.

The Charge Generation Layer

The CGL 18 may thereafter be applied to the undercoat layer 14. Any suitable charge generation binder including a charge generating/photoconductive material, which may be in the form of particles and dispersed in a film-forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film-forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

A number of titanyl phthalocyanines, or oxytitanium phthalocyanines for the photoconductors illustrated herein are photogenerating pigments known to absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the disclosures of which are totally incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the disclosure of which is totally incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

Any suitable inactive resin materials may be employed as a binder in the CGL 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly(4,4'-dihydroxydiphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, the charge generating material is dispersed in an amount of from about 5 percent to about 95 percent by volume, from about 20 percent to about 80 percent by volume, or from about 40 percent to about 60 percent by volume of the resinous binder composition.

The CGL 18 containing the charge generating material and the resinous binder material generally ranges in thickness of from about 0.1 micrometer to about 5 micrometers, or from about 0.2 micrometer to about 3 micrometers. In certain embodiments, the charge generating materials in CGL 18 may include chlorogallium phthalocyanine, hydroxygallium phthalocyanines, or mixture thereof.

The CGL thickness is generally related to binder content. Higher binder content compositions generally employ thicker layers for charge generation layers.

The Charge Transport Layer

Although the CTL is discussed specifically in terms of a single layer 20, the details apply to embodiments having dual or multiple charge transport layers. Typically, the CTL 20 is a coating solution applied over the CGL 18. In certain embodiments, the CTL with an adjacent ground strip layer is disposed on the CGL. In certain embodiments, the CTL 20 may include a transparent organic polymer or a non-polymeric material. Such transparent organic polymers and non-polymeric materials are capable of supporting the injection of photogenerated holes or electrons from the CGL 18 to allow the transport of these holes/electrons through the CTL 20 to selectively discharge the surface charge on the imaging member surface. In certain embodiments, the CTL 20 supports holes transporting, and protects the CGL 18 from abrasion or chemical attack, thereby extends the service life of the imaging member. Interestingly, the CTL 20 may be a substantially non-photoconductive material, yet it supports the injection of photogenerated holes from the CGL 18 below.

The CTL 20 is normally transparent in a wavelength region in which the electrophotographic imaging member is to be used when exposure is affected there to ensure that most of the incident radiation is utilized by the underlying charge generation layer 18. The CTL 20 should exhibit excellent optical transparency with negligible light absorption and no charge generation when exposed to a wavelength of light useful in xerography, e.g., 400 to 900 nanometers. In the case when the imaging member is prepared with the use of a transparent support substrate 10 and also a transparent conductive ground plane 12, image wise exposure or erase may be accomplished through the substrate 10 with all light passing through the back side of the support substrate 10. In this particular case, the materials of the CTL 20 need not have to be able to transmit light in the wavelength region of use for electrophotographic imaging processes if the charge generating layer 18 is sandwiched between the support substrate 10 and the charge transport layer 20. In all events, the exposed outermost charge transport layer 20 in conjunction with the charge generating layer 18 is an insulator to the extent that an electrostatic charge deposited/placed over the charge transport layer is not conducted in the absence of radiant illumination. Importantly, the charge transport layer 20 should trap minimal or no charges as the charge pass through it during the image copying/printing process.

The CTL 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale.

The charge transport component may be added to a plasticized film-forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the CGL 18 and capable of allowing the transport of these holes through the CTL 20 in order to discharge the surface charge on the CTL 20. The high mobility charge transport component may comprise small molecules of an organic compound which cooperate to transport charge between molecules and ultimately to the surface of the CTL 20.

A number of charge transport compounds can be included in the CTL 20. Examples of charge transport components are aryl amines of the following formulas:

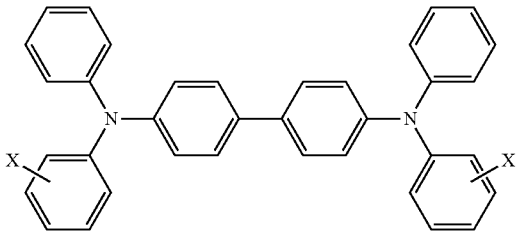

and

-continued

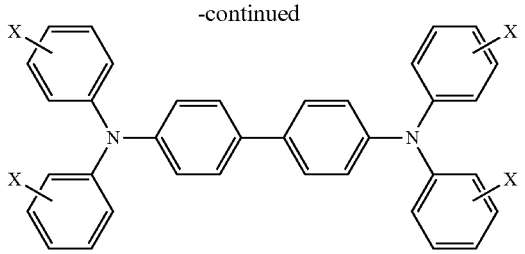

wherein each X is independently alkyl, alkoxy, aryl, and derivatives thereof, or a halogen, or mixtures thereof. In certain embodiments, each X is independently Cl or methyl. Additional examples of charge transport components are aryl amines of the following formulas:

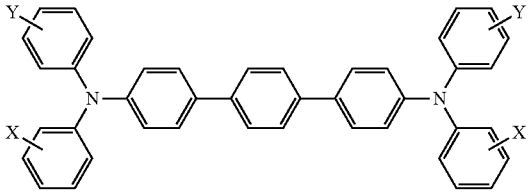

and

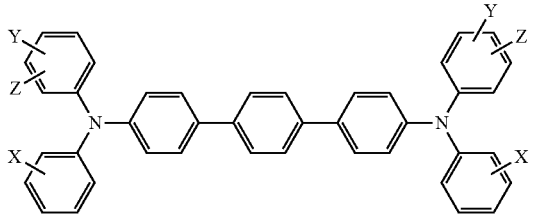

wherein X, Y and Z are independently alkyl, alkoxy, aryl, halogen, or mixtures thereof, and wherein at least one of Y and Z are present.

Alkyl and alkoxy may be substituted or unsubstituted, containing from 1 to about 25 carbon atoms, and more specifically, from 1 to about 12 carbon atoms, such as methyl, ethyl, propyl, butyl, pentyl, and the corresponding alkoxides. Aryl may be substituted or unsubstituted, containing from 6 to about 36 carbon atoms, such as phenyl, and the like. Halogen includes chloride, bromide, iodide, and fluoride.

Exemplary charge transport components include aryl amines such as N,N'-diphenyl-N,N'-bis(methyl)phenyl)-1,1-biphenyl-4,4'-diamine, N,N,N',N'-tetra-p-tolyl-1,1'-biphenyl-4,4'-diamine, N,N'-diphenyl-N,N'-bis(chlorophenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, In one embodiment, the charge transport component is N,N'-diphenyl-N,N'-bis(3-methyl phenyl)-1,1'-biphenyl-4,4'-diamine (TPD) and N,N,N',N'-tetra-p-tolyl-1,1'-biphenyl-4,4'-diamine (TM-TPD), and the like. Other known charge transport layer components may be selected in embodiments, reference for example, U.S. Pat. Nos. 4,921,773 and 4,464,450, the disclosures of which are totally incorporated herein by reference.

In one embodiment, the charge transport component is N,N'-diphenyl-N,N-bis(3-methyl phenyl)-1,1'-biphenyl-4,4'-diamine (TPD). In another embodiment, the charge transport component is N,N,N',N'-tetra-p-tolyl-1,1'-biphenyl-4,4'-diamine (TM-TPD).

Examples of the binder materials selected for the CTL 20 include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof. In one embodiment, the charge transport layer includes polycarbonates.

Typically, the formulation of the CTL 20 is a solid solution which includes a charge transport compound molecularly dispersed or dissolved in a film forming polycarbonate binder, such as poly(4,4'-isopropylidene diphenyl carbonate) (i.e., bisphenol A polycarbonate), or poly(4,4'-diphenyl-1,1'-cyclohexane carbonate) (i.e., bisphenol Z polycarbonate).

Bisphenol A polycarbonate used for the CTL 20 formulation is available commercially: MAKROLON (from Farbensabricken Bayer A.G) or FPC 0170 (from Mitsubishi Chemicals). Bisphenol A polycarbonate, poly(4,4'-isopropylidene diphenyl carbonate), has a weight average molecular weight of from about 80,000 to about 250,000, and a molecular structure of Formula X below:

Formula X

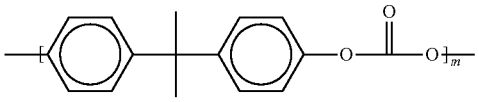

wherein m is the degree of polymerization, from about 310 to about 990. Bisphenol Z polycarbonate, poly(4,4'-diphenyl-1,1'-cyclohexane carbonate), has a weight average molecular weight of from about 80,000 to about 250,000, and a molecular structure of Formula Y below:

Formula Y

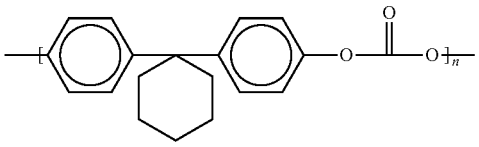

wherein n is the degree of polymerization, from about 270 to about 850.

CTL 20 is an insulator to the extent that the electrostatic charge placed on the CTL 20 surface is not conducted in the absence of illumination at a rate sufficient to prevent formation and retention of an electrostatic latent image thereon. The CTL 20 is substantially non-absorbing to visible light or radiation in the region of intended use. The CTL 20 is yet electrically "active," as it allows the injection of photogenerated holes from the charge generation layer 18 to be transported through itself to selectively discharge a surface charge presence on the surface of the CTL 20.

Any suitable and conventional technique may be utilized to form and thereafter apply the CTL 20 coating solution to the supporting substrate layer. The CTL 20 may be formed in a single coating step to give single CTL 20 or in multiple coating steps to produce dual layered or multiple layered CTLs. Dip coating, ring coating, spray, gravure or any other coating methods may be used. For dual layered design, the CTL 20 includes a top CTL and a bottom CTL in contiguous contact with the CGL 18. The top CTL may contain less charge transport compound than the bottom CTL for impacting mechanically robust function. The top and bottom CTLs may have different thickness, or the same thickness. Drying of the applied wet coating layer(s) may be effected by any suitable conventional technique such as oven drying, infra red radiation drying, air drying and the like.

In a conventional flexible electrophotographic imaging member manufacturing process, the polycarbonate containing CTL 20 has a coefficient of thermal contraction of from about 3 to about 4 times, or approximately 3.7 times, greater than that of the substrate support 10. As a result, the flexible imaging member (if unrestrained) exhibits spontaneous upward curling due to the result of larger dimensional shrinkage in the CTL 20 than that of the support substrate 10. Without being bounded by theory, the development of the upward curling may be explained by the following mechanisms: (1) while the photoreceptor web after application of wet CTL coating is dried at elevated temperature (120° C.), the solvent(s) of the CTL coating solution evaporates leaving a viscous free flowing CTL liquid where the CTL releases internal stress, and maintains its lateral dimension stability without causing the occurrence of dimensional contraction; (2) during the cool down period, the temperature falls and reaches the glass transition temperature of the CTL ($Tg_{CTL}$) at 85° C., the CTL instantaneously solidifies and adheres to the underneath CGL as it transforms from being a viscous liquid into a solid layer; (3) as the temperature drops from 85° C. down to the 25° C. room ambient, the solid CTL of the photoreceptor web laterally contracts more than the flexible substrate support due to the greater dimensional shrinkage (because of larger thermal contraction coefficient) than that of the substrate support. Such differential in dimensional contraction results in tension strain built-up in the CTL, which pulls the photoreceptor web upwardly to exhibit curling.

The internal tensile pulling strain built-up in the dried CTL 20 (caused by differential dimensional contraction between CTL 20 and substrate 10 to result in spontaneous upward imaging member curling) can be calculated according to the expression of equation (1) below:

$$\in=(\alpha_{CTL}-\alpha_{sub})(Tg_{CTL}-25^\circ\ C.) \quad (1)$$

wherein $\in$ is the internal strain build-in in the charge transport layer, $\alpha_{CTL}$ and $\alpha_{sub}$ are coefficient of thermal contraction of CTL 20 and substrate 10 respectively, and $Tg_{CTL}$ is the glass transition temperature of the CTL 20.

Plasticizing Charge Transport Layer and Ground Strip Layer

To minimize the thermal dimensional contraction mismatched magnitude between the CTL and the substrate, liquid plasticizer(s) incorporation into the CTL 20 to effect $Tg_{CTL}$ and internal strain C reduction has been found to give successful imaging member curl suppression result in accordance to equation (1). The selection of viable plasticizer(s) for CTL incorporation is based on the facts that they are (a) high boiler liquids with boiling point exceeding 250° C., (b) completely miscible/compatible with both the polymer binder and the charge transport component such that their incorporation into the charge transport layer material matrix cause no deleterious photoelectrical function of the resulting imaging member, and (c) and maintain optical clarity of the prepared plasticized CTL. Plasticized CTL is described in U.S. Patent Publication No. 2010-0279219, the entire disclosure of which is incorporated by reference herein.

In embodiments, the charge transport layer may comprises the same liquid plasticizer in the anti-curl back coating described herein. Such liquid plasticizer may be miscible with both the polycarbonate and the charge transport compound.

In addition to the success of CTL plasticizing, further effort of ground strip layer plasticization is also pursued to likewise provide supplemental imaging member curl control. Referring back to FIG. 1, the amount of plasticizer incorporation into each of the CTL 20 or the ground strip layer 19 is between about 5 and about 20 weight percent, or between about 8 and about 12 weight percent based on the total weight of each respective plasticized layer. The typical thickness of a plasticized CTL 20 (being a single, dual, or multiple layered CTLs) after drying is from about 10 micrometers to about 40 micrometers or from about 15 micrometers to about 35 micrometers for optimum photoelectrical and mechanical results. The plasticized CTL 20, utilizing a polycarbonate binder, have a Young's Modulus in the range of from about $2.5\times10^5$ psi ($1.7\times10^4$ Kg/cm$^2$) to about $4.5\times10^5$ psi ($3.5\times10^4$ Kg/cm$^2$), a thermal contraction coefficient of between about $5\times10^{-5}$/° C. and about $12\times10^{-5}$/° C., and a glass transition temperature, $Tg_{CTL}$, above 50° C.

Plasticized Anti-Curl Back Coating of Present Disclosure

The effort of plasticizer incorporation into both the CTL 20 and the ground strip layer 19 has been successful to provide the benefits of effecting imaging member curl suppression for ACBC elimination and CTL mechanical fatigue cracking life extension outcome during machine imaging member cyclic function. Nonetheless, the exposure of the substrate support 10 (without the protection of an ACBC) to the sliding contact friction against the components of imaging member belt support module during xerographic imaging process causes development of early onset of wear failure under normal machine usage.

A plasticized ACBC 1 may be applied onto the back side of the substrate 10 to provide protection and render absolute imaging member flatness. The plasticized ACBC 1 may comprise one or more of a film forming polymer, a liquid plasticizer, and a copolyester adhesion promoter.

Typical film forming polymers selected for plasticized ACBC 1 may be the same or different from those used in the CTL 20. Non-limiting examples of polymers include polycarbonates having a weight average molecular weight of from about 80,000 to about 250,000 and having the molecular structures shown below:

Formula A-1

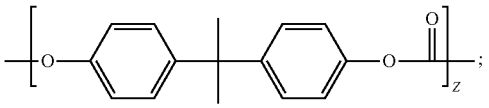

(bisphenol A carbonate)

Formula A-2

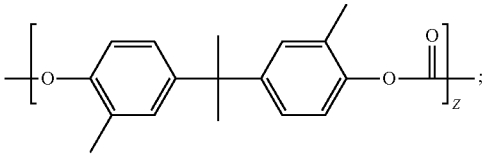

-continued

Formula A-3

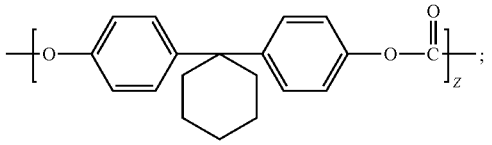

(bisphenol Z carbonate)

Formula A-4

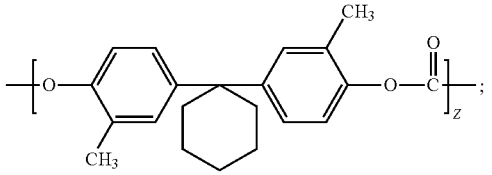

Formula A-5

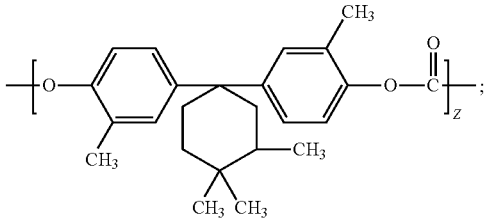

Formula A-6

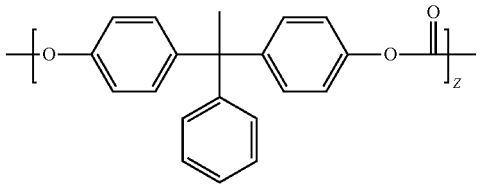

wherein z is from about 200 to about 1200, or from about 250 to about 1000. Generally, the polycarbonate is present in an amount of from about 50 to about 90 percent by weight, from about 60 to about 85 percent by weight, or from about 70 to about 80 percent by weight based on the total weight of the ACBC. The ACBC of the present disclosure comprises a liquid plasticizer. The liquid plasticizer in the ACBC may be the same as or different from the liquid plasticizer in the CTL. Suitable liquid plasticizers includes (1) organic liquid plasticizers such as phthalates, and bisphenol liquids, (2) liquid oligomeric styrenes, or derivatives thereof, such as low molecular weight polystyrenes, and (3) fluoro-containing organic liquids which are capable of lowering the surface energy of the formulated coating layer.

(1) Organic Liquid Plasticizers

Organic liquid plasticizers having the following formula:

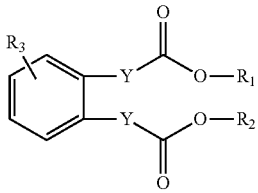

wherein Y is O or null; each $R_1$ and $R_2$ is independently $C_1$-$C_6$ alkyl or $R_1$ and $R_2$ taken together with the O atom of the ester groups to which they are attached and part of the benzene ring form a heterocyclic ring; $R_3$ is H or —C(O)$OR_4$, and $R_4$ is $C_1$-$C_6$ alkyl. In certain embodiments, each $R_1$, $R_2$ and $R_4$ is independently methyl, ethyl, propyl or butyl.

Non-limiting exemplary phthalates include the following

Formula (I)

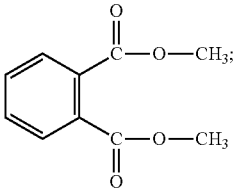

Formula (IA)

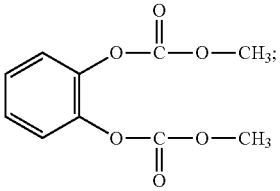

Formula (II)

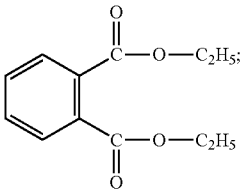

Formula (IIA)

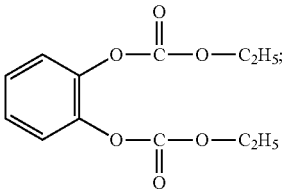

-continued

Formula (III)

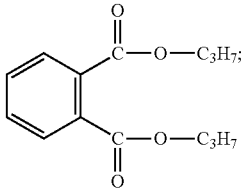

Formula (IV)

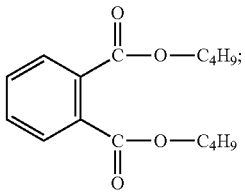

Formula (V)

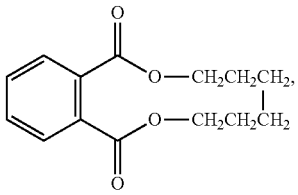

Formula (VI)

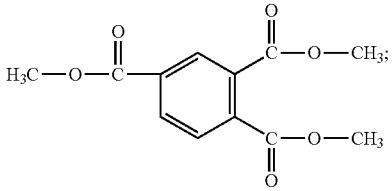

Formula (VII)

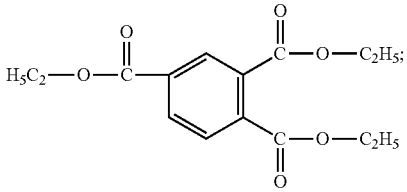

and mixtures thereof.

Non-limiting exemplary monomeric carbonates include the following:

Formula (1)

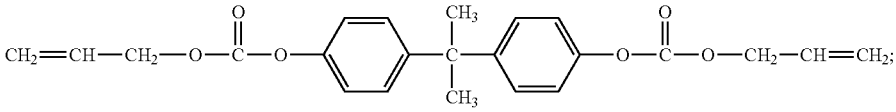

Formulas (2) to (5) may be conveniently derived from Formula (1):

Formula (2)

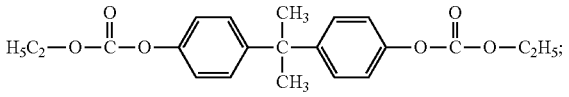

Formula (3)

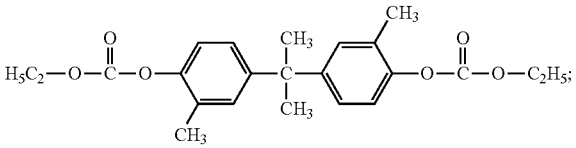

Formula (4)

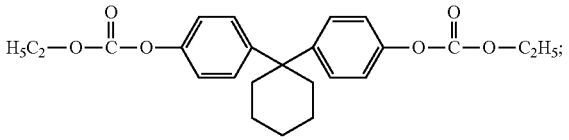

Formula (5)

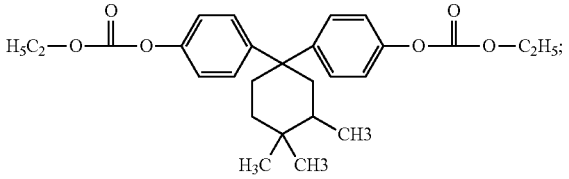

Formula (6)

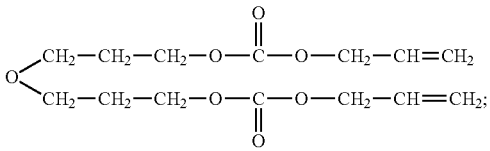

Diethylene glycol bis(allyl carbonate)

and mixtures thereof.

(2) Liquid Oligomeric Styrenes

Non-limiting exemplary styrenes include the following:

Formula (B)

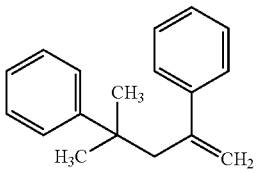

Non-limiting exemplary low molecular weight liquid polystyrenes include the following:

Formula (A)

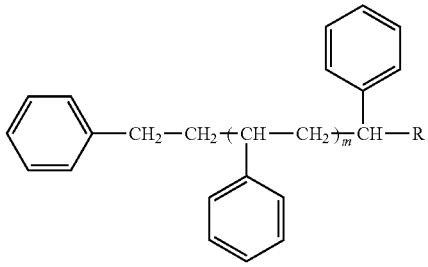

wherein R is selected from the group consisting of H, $CH_3$, $CH_2CH_3$, and $CH{=}CH_2$, and where m is between 0 and 3.

(3) Fluoro Containing Organic Liquids

The fluoro-containing organic liquids render plasticizing effect for eliminating the CTL/ground strip layer internal stress/strain build-up for curl control, and provides surface energy reduction effect to impact surface slipperiness enhancement in the resulting CTL/ground strip layer. The same fluoro-containing organic liquids may be used in the ACBC. The fluoro-organic liquids include fluoroketones having the formula:

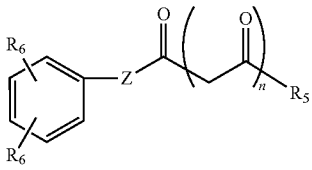

wherein $R_5$ is $C_1$-$C_6$ alkyl, perhaloalkyl, or haloalkyl; Z is null or alkylene; n is 0 or 1; $R_6$ is H, $C_1$-$C_6$ alkoxy, perhaloalkyl, or haloalkyl.

Non-limiting examples fluoroketones are 3-(trifluoromethyl)phenylacetone, 2'-(trifluoromethyl)propiophenone, 2,2,2-trifluoro-2',4'-dimethoxyacetophenone, 3',5'-bis(trifluoromethyl)acetophenone, 3'-(trifluoromethyl)propiophenone, 4'-(trifluoromethyl)propiophenone, 4,4,4-trifluoro-1-phenyl-1,3-butanedione, 4,4-difluoro-1-phenyl-1,3-butanedione, and the like. The structures of these fluoroketones are shown below:

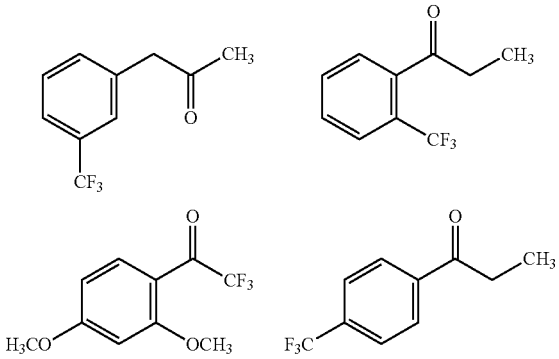

-continued

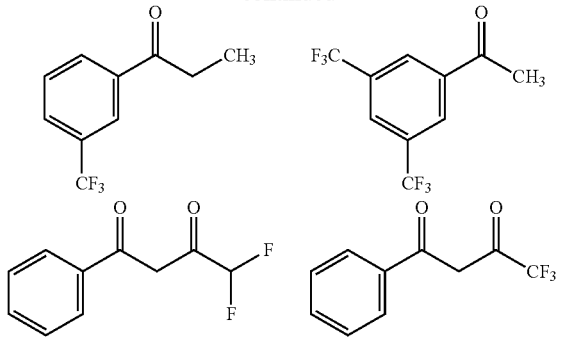

The amount of plasticizer in the ACBC (or plasticized ACBC) in the disclosed embodiments of imaging members is from about 5 to about 20 weight percent, from about 8 to about 16 weight percent, or from about 12 to about 16 weight percent, based on the total weight of the plasticized ACBC formulation.

Copolyester adhesion promoters may be added to the ACBC to enhance adhesion bonding of ACBC to substrate. Non-limited specific examples of the copolyester adhesion promoters of ACBC to substrate are 49,000 resin (Rohm and Haas), Vitel PE-100, Vitel PE-200, Vitel PE-2200, Vitel PE-307 (from Bostik Inc.). The effective amount of an adhesion promoter presence in the ACBC is in a weight ratio of polycarbonate to copolyester adhesion promoter of from about 80:20 to about 99:1, from about 85:15 to about 95:5 or about 90:10.

The amount of adhesion promoter in the ACBC (or plasticized ACBC) in the disclosed embodiments of imaging members is from about 1 to about 15 weight percent, from about 3 to about 10 weight percent, or from about 5 to about 8 weight percent, based on the total weight of the plasticized ACBC formulation.

Figure 2:
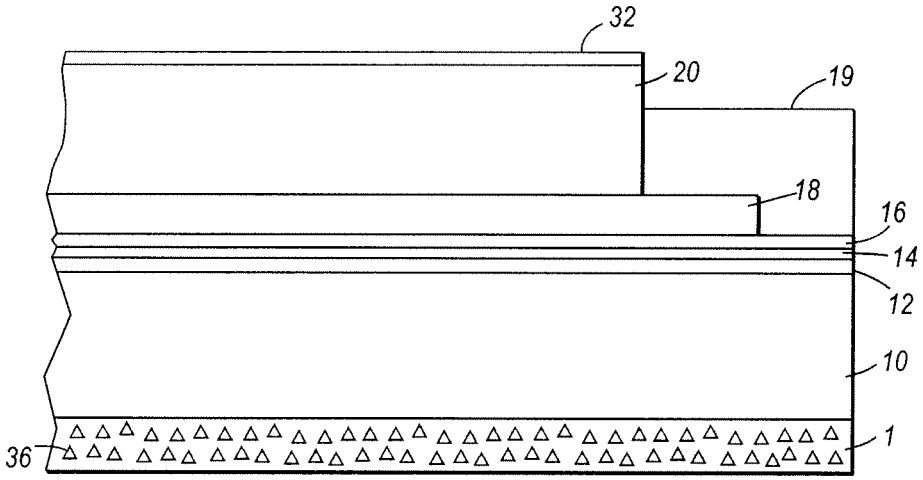
FIG. 2 is a schematic cross-sectional view of a second exemplary embodiment in which the anti-curl back coating of the flexible imaging member, prepared according to the present disclosure, includes organic particles dispersion.

In certain embodiments, the ACBC 1 may include an organic particle dispersion. As shown in FIG. 2, it demonstrates a flexible multi-layered electrophotographic imaging member prepared according to the exact same material formulations, compositions, layer dimensions, methodology, and procedures as those described in each of the embodiments described in FIG. 1, except that the disclosed plasticized ACBC 1 is included a dispersion of organic particles in its material matrix. That means the imaging members comprise the exact same substrate 10, conductive ground plane 12, hole blocking layer 14, adhesive interface layer 16, CGL 18, plasticized ground strip layer 19, plasticized CTL 20, plasticized ACBC 1, and an optional overcoat layer 32, but with the exception that the plasticized ACBC 1 in each imaging member is modified to incorporate homogeneous dispersion of organic particles 36 into its layer matrix to render sliding contact friction reduction for effecting scratch and wear resistance enhancement. The organic particles 36 dispersed in the plasticized ACBC 1 material matrix include, for example, polyterafluoroethylene (PTFE) available as ZONYL MP1100 and ZONYL MP1000 from E.I. du Pont de Nemours & company; waxy polyethylene having molecular formula $CH_3(CH_2)_mCH_3$, where m is between about 5 and about 15, available as ACUMIST from Allied-Signal, Inc.; Petrac Oleamide with a molecular formula $CH_3(CH_2)_7CH{=}CH(CH_2)_7C{=}OCNH_2$ available from synthetic Products company; and Petrac Erucamide with molecular formula $CH_3(CH_2)_7CH{=}CH(CH_2)_{11}C{=}OCNH_2$ available from synthetic Products company. The average particle size of the organic particle is from about 0.02 micrometer to about 3 micrometers, or from about 0.01 micrometer to about 2 micrometers. The organic particle is present in an amount of from about 1 to about 10 weight percent, or from about 4 to 8 weight percent based on the total weight of the resulting plasticized ACBC layer 1.

Figure 3:
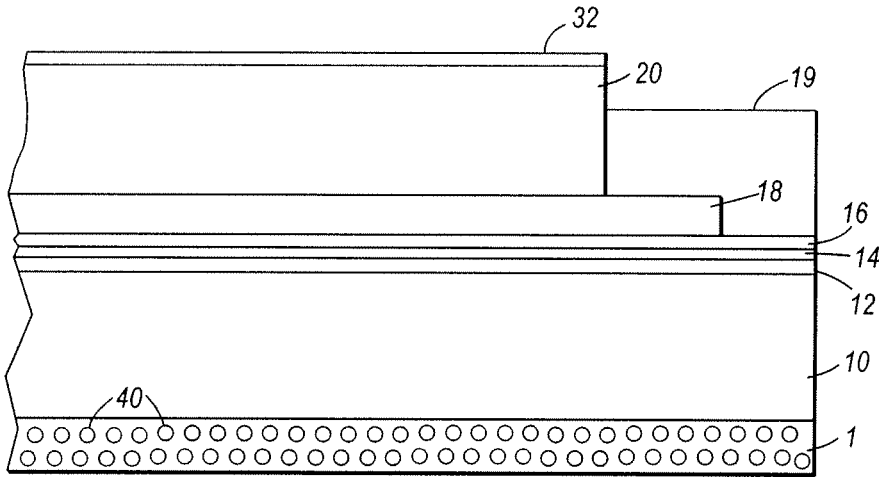
FIG. 3 is a schematic cross-sectional view of a third exemplary embodiment in which the anti-curl back coating of the imaging member, prepared according to the present disclosure, includes inorganic particles dispersion.

In certain embodiments, the ACBC may further include an inorganic particle. Embodiments of flexible imaging members shown in FIG. 3 are likewise prepared according to the exact same material formulations, compositions, layer dimensions, methodology, and procedures as those described in each of the embodiments described in FIG. 2, but with the exception that the organic particles 36 dispersed in the plasticized ACBC 1 in each imaging member are being replaced by homogeneous inorganic particles dispersion 40 in its plasticized ACBC material matrix. The inorganic particles 40 are scratch/wear resistance hard particles such as, for example, microcrystalline silica available from Malvern Minerals Co., amorphous silica available from Degussa Corp., and various metal oxides such as aluminum oxide, titanium dioxide, Zirconium oxides, and the like. The average particle size of the inorganic particle is from about 0.02 micrometer to about 3 micrometers, or from about 0.01 micrometer to about 2 micrometers. The inorganic particle is present in an amount of from about 1 to about 10 weight percent, or from about 4 to 8 weight percent based on the total weight of the resulting plasticized ACBC layer 1.

Figure 4:
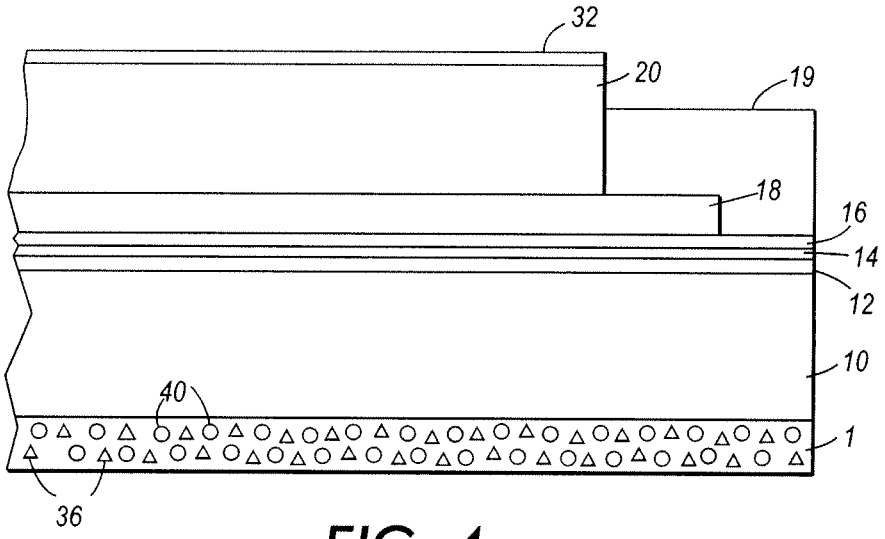
FIG. 4 is a schematic cross-sectional view of a fourth exemplary embodiment in which the anti-curl back coating of the flexible imaging member, prepared according to the present disclosure, includes a mixture of organic and inorganic particles dispersion.

In certain embodiments, the disclosed plasticized ACBC 1 may include a mixture dispersion of an organic particle and an inorganic particle. Embodiments of flexible imaging members shown in FIG. 4 are likewise prepared according to the exact same material formulations, compositions, layer dimensions, methodology, and procedures as those described in each of the embodiments described in FIG. 1, but with the exception that the plasticized ACBC 1 includes homogeneous dispersion of binary mixture of organic particles 36 and inorganic particles 40 in the layer matrix to impart the dual benefits of sliding contact reduction and scratch/wear resistance enhancement. The weight ratio of the organic particles to the inorganic particles (in all combination variances) is from about 10:90 to about 90:10, from about 70:30 to about 30:70, or about 50:50. The binary mixture of organic/inorganic particles dispersion is present in an amount of from about 1 to about 10 weight percent or from about 4 to 8 weight percent based on the total weight of the resulting plasticized ACBC layer 1.

In certain embodiments, the plasticized ACBC 1 includes a polycarbonate, a copolyester adhesion promoter, a liquid plasticizer. In extended certain embodiments, the plasticized ACBC 1 includes particles dispersion according to the detailed descriptions in each of the preceding embodiments of present disclosure.

In specific embodiments, the ACBC includes from about 70 to about 80 weight percent polycarbonate, from about 8 to about 16 weight percent plasticizer, from about 5 to about 8 weight percent adhesion promoter, and from about 4 to about 8 weight percent organic or inorganic or 50:50 mixture organic/inorganic particles dispersion, based on the total weight of the plasticized ACBC.

Typically, the plasticized ACBC 1 has a thickness of from about 5 micrometers to about 40 micrometers, from about 10 micrometers and 30 micrometers, or from about 10 micrometers to about 20 micrometers in thickness. In certain embodiments, the plasticized ACBC 1 has a thickness of from about 10 micrometers to about 20 micrometers for an imaging member with a plasticized CTL 20 having a thickness of from 15 micrometers to about 35 micrometers.

In certain embodiments, the film forming polycarbonate and plasticizer in ACBC 1 are the same as that in the CTL 20. The plasticized ACBC 1 according to such embodiment likewise have a Young's Modulus in the range of from about $2.5\times10^5$ psi ($1.7\times10^4$ Kg/cm$^2$) to about $4.5\times10^5$ psi ($3.5\times10^4$ Kg/cm$^2$), and a thermal contraction coefficient of between about $5\times10^{-5}$/° C. and about $12\times10^{-5}$/° C.

In the extended embodiments of present disclosure, the CTL 20 and the ground strip layer 19 may have all the exact same compositions, material make-up, dimensions, and identical preparation procedures described in all the preceding embodiments, but with the exception that plasticizer was not incorporated in the CTL.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. Therefore, typical overcoat layer is formed from a hard and wear resistance polymeric material. In embodiments, the overcoat layer 32 may have a thickness ranging from about 0.1 micrometer to about 10 micrometers or from about 1 micrometer to about 10 micrometers, or in a specific embodiment, about 3 micrometers. These over-coating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including nano particles of aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 micrometer, or no more than 10 micrometers, and in further embodiments have a thickness of at least about 2 micrometers, or no more than 6 micrometers.

In summary, the present embodiments provide a plasticized ACBC 1 prepared according to the descriptions of the disclosure, to have enhanced physical and mechanical properties, scratch/wear resistance, and good optical clarity of suitable transparency to allow good imaging member belt back erase by radiant light. The plasticized ACBC 1 formulations of the present embodiments have excellent adhesion bonding strength to the substrate 10 and give effective curling control capacity to render absolute imaging member flatness.

In electrophotographic reproducing or digital printing apparatuses using a flexible imaging member belt prepared to comprise a plasticized CTL and a plasticized ACBC of present disclosure, a light image is recorded in the form of an electrostatic latent image upon a photosensitive member and the latent image is subsequently rendered visible by the application of a developer mixture. The developer, having toner particles contained therein, is brought into contact with the electrostatic latent image to develop the image on the imaging member belt which has a charge-retentive surface. The developed toner image can then be transferred to a copy out-put substrate, such as paper, that receives the image via a transfer member.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The development of the presently disclosed embodiments will further be demonstrated in the non-limited Working Examples below. They are, therefore in all respects, to be considered as illustrative and not restrictive nor limited to the materials, conditions, process parameters, and the like recited herein. The scope of embodiments are being indicated by the appended claims rather than the foregoing description. All changes that come within the meaning of and range of equivalency of the claims are intended to be embraced therein. All proportions are by weight unless otherwise indicated. It will be apparent, however, that the invention can be practiced with many types of compositions and can have many different uses in accordance with the disclosure above and as pointed out hereinafter.

Example 1

Anti-Curl Back Coating Control Example

An anti-curl back coating (ACBC) was prepared by combining 88.2 grams of bisphenol A polycarbonate resin (FPC170 from Mitsubishi Chemicals), 7.12 grams VITEL PE-2200 copolyester (available from Bostik, Inc. Middleton, Mass.) and 1,071 grams of methylene chloride in a carboy container to form a coating solution containing 8.2 percent solids. The container was covered tightly and placed on a roll mill for about 24 hours until the polycarbonate and polyester were dissolved in the methylene chloride to form the ACBC solution. The ACBC solution was then applied onto a 3.5 mils (89 micrometers) thickness biaxially oriented polyethylene naphthalate substrate (PEN, KADALEX, available from DuPont Teijin Films) by following the standard hand coating procedures and dried to a maximum temperature of 125° C. in the forced air oven for one minute to produce an optically clear 17 micrometers of dried ACBC thickness. The obtained ACBC over the PEN, if unrestrained, curled spontaneously into a 1½ inch roll, and to be used to serve as a Control.

The bisphenol A polycarbonate used has a weight average molecular weight of 120,000 and a molecular formula shown below:

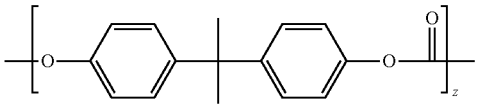

where z is about 470.

Example 2

Disclosure Anticurl-Back Coating Example

Four disclosure ACBC formulations (2a, 2b, 2c, and 2d) were prepared using the identical materials, compositions, and following the exact same procedures as described in the Anti-Curl Back Coating Control Example above, except that 8, 10, 12, and 14 weight percent of diethyl phthalate (DEP) plasticizer (based on the total weight each reformulated ACBC layer matrix) were included into each of the ACBC formulation to assess for respective curl control. The plasticizer DEP (available from Sigma-Aldrich Company) has a boiling point of about 295° C. and has the molecular formula shown below:

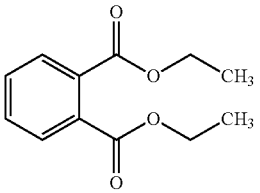

The resulting plasticized ACBC layers thus obtained, after drying and cooling to room ambient, was optically clear and had a notable reduction in upward curling with respective to the increase of DEP content according to the data listed in the following Table 1:

TABLE 1

| Example | Diethyl Phthalate Content (% wt) | Diameter of Curvature |
|---|---|---|
| 1 | 0 | 1.5 inches |
| 2a | 8 | 12.0 inches |
| 2b | 10 | 14.0 inches |
| 2c | 12 | Nearly Flat |
| 2d | 14 | Flat |

Control Imaging Member Preparation Example

A conventional negatively charged flexible electrophotographic imaging member web was prepared by providing a 0.02 micrometer thick titanium layer coated substrate of a biaxially oriented polyethylene naphthalate substrate (PEN, available as KADALEX from DuPont Teijin Films) having a thickness of 3½ mils (89 micrometers), and extrusion coating the titanized KADALEX substrate with a blocking layer solution containing a mixture of 6.5 grams of gamma aminopropyltriethoxy silane, 39.4 grams of distilled water, 2.1 grams of acetic acid, 752.2 grams of 200 proof denatured alcohol and 200 grams of heptane. The resulting wet coating layer was allowed to dry for 5 minutes at 135° C. in a forced air oven to remove the solvents from the coating and effect the formation of a crosslinked silane blocking layer. The resulting blocking layer had an average dry thickness of 0.04 micrometer as measured with an ellipsometer.

An adhesive interface layer was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a charge generating layer. The charge generating layer (CGL) dispersion was prepared as described below:

To a 4 ounce glass bottle was added IUPILON 200, a polycarbonate of poly(4,4'-diphenyl)-1,1'-cyclohexane carbonate (PC-z 200, available from Mitsubishi Gas Chemical Corporation) (0.45 grams), and tetrahydrofuran (50 milliliters), followed by hydroxygallium phthalocyanine Type V (2.4 grams) and ⅛ inch (3.2 millimeters) diameter stainless steel shot (300 grams). The resulting mixture was placed on a ball mill for about 20 to about 24 hours to obtain a slurry. Subsequently, a solution of poly(4,4'-diphenyl-1,1'-cyclohexane carbonate) (2.25 grams) having a weight average molecular weight of 20,000 (PC-z 200) dissolved in tetrahydrofuran (46.1 grams) was added to the hydroxygallium phthalocyanine slurry. The resulting slurry was placed on a shaker for 10 minutes and thereafter coated onto the adhesive interface by extrusion application process to form a layer having a wet thickness of 0.25 mil. A strip of about 10 millimeters wide along one edge of the substrate web stock bearing the blocking layer and the adhesive layer was deliberately left uncoated by the charge generating layer to facilitate adequate electrical contact by a ground strip layer to be applied later. The resulting CGL containing poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

This coated web stock was simultaneously coated over with a charge transport layer (CTL) and a ground strip layer by co-extrusion of the coating materials. The CTL was prepared as described below:

To an amber glass bottle was added bisphenol A polycarbonate thermoplastic having an average molecular weight of about 120,000 (FPC 0170, commercially available from Mitsubishi Chemicals) and a charge transport compound of N,N'-diphenyl-N,N'-bis(3-methylphenyl)-1,1'-biphenyl-4,4'-diamine. The weight ratio of the bisphenol A polycarbonate thermoplastic and N,N'-diphenyl-N,N'-bis(3-methylphenyl)-1,1'-biphenyl-4,4'-diamine was 1:1. The resulting mixture was dissolved in methylene chloride such that the solid weight percent in methylene chloride was 15 percent by weight. Such mixture was applied on the charge generating layer by extrusion to form a coating which upon drying in a forced air oven gave a dry CTL of 29 micrometers thick.

The strip, about 10 millimeters wide, of the adhesive layer left uncoated by the charge generator layer, was coated with a ground strip layer during the co-extrusion process. The ground strip layer coating mixture was prepared as described below:

To a carboy container was added 23.8 grams of bisphenol A polycarbonate resin (FPC 0170) and 332 grams methylene chloride. and methylene chloride (332 grams). The container was covered tightly and placed on a roll mill for about 24 hours until the polycarbonate was dissolved and gave a 7.9 percent by weight solution. The prepared solution was mixed for 15-30 minutes with about 94 grams of graphite dispersion solution (available as RW22790, from Acheson Colloids Company) to give ground strip layer coating solution. (Note: The graphite dispersion solution, RW22790 as commercially obtained, contained a 12.3 percent by weight solids including 9.41 parts by weight of graphite, 2.87 parts by weight of ethyl cellulose, and 87.7 parts by weight of solvent).

To effect homogeneous graphite dispersion, the resulting ground strip layer coating solution was then mixed with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL, to the electrophotographic imaging member web to form an electrically conductive ground strip layer having a dried thickness of about 19 micrometers.

The imaging member web stock containing all of the above layers was then passed through 125° C. in a forced air oven for 3 minutes to simultaneously dry both the CTL and the ground strip. Since the CTL has a Young's Modulus of $3.5\times10^5$ psi ($2.4\times10^4$ Kg/cm$^2$) and a thermal contraction coefficient of $6.5\times10^{-5}$/° C. compared to the Young's Modulus of $5.5\times10^5$ psi ($3.8\times10^4$ Kg/cm$^2$) and thermal contraction coefficient of $1.8\times10^{-5}$/° C. for the PEN substrate support, the CTL was about 3.6 times greater in dimensional shrinkage than that of PEN substrate support. Therefore, the imaging member web if unrestrained at this point would curl upwardly into a 1½-inch tube.

To effect imaging member curl control, a conventional ACBC was prepared by combining 88.2 grams of FPC 0170 bisphenol A polycarbonate resin, 7.12 grams VITEL PE-2200 copolyester (available from Bostik, Inc. Middleton, Mass.), and 1,071 grams of methylene chloride in a carboy container to form a coating solution containing 8.2 percent solids. The container was covered tightly and placed on a roll mill for about 24 hours until the polycarbonate and polyester were dissolved in methylene chloride to form an anti-curl back coating solution. The ACBC solution was applied to the rear surface (side opposite to the charge generating layer and CTL) of the electrophotographic imaging member web by extrusion coating and dried to a maximum temperature of 125° C. in a forced air oven for about 3 minutes to produce a dried ACBC having a thickness of 17 micrometers and flattening the imaging member. The flexible imaging member thus obtained was served as an imaging member control.

Disclosure Imaging Member Preparation Example I

A negatively charged flexible electrophotographic imaging member web was prepared to have the exact same structural configuration, identical material compositions, layer dimensions, and procedures as those described in the Control Imaging Member Preparation Example above, but with the exception that the CTL, ground strip layer, and the ACBC were all incorporated a liquid DEP plasticizer. In essence, the imaging member contained the exact same substrate, conductive ground plane, hole blocking layer, adhesive interface layer, CGL, and ground strip layer, except that:

The CTL was incorporated with 8 weight percent of DEP based on the total weight of the resulting plasticized CTL. Likewise, the ground strip layer was incorporated with 8 weight percent of DEP based on the total weight of the resulting plasticized ground strip layer.

The imaging member having 29 micrometers plasticized CTL thickness obtained after dryness exhibited a nearly flat (a slightly notably upward curling) configuration prior to application of a plasticized ACBC of this disclosure.

The ACBC, included 12 weight percent of DEP based on the total weight of plasticized ACBC layer, was added onto the back side of the substrate support.

The resulting imaging member containing DEP plasticizer incorporation in the CTL, ground strip layer, and ACBC prepared according to material reformulations description of this disclosure exhibited absolute flatness.

In relative comparison, the Young's Modulus of the plasticized CTL was about $3.5\times10^5$ psi ($2.4\times10^4$ Kg/cm$^2$) and a thermal contraction coefficient of about $6.5\times10^{-5}$/° C.; the Young's Modulus of the plasticized ACBC was about $3.2\times10^5$ psi ($2.2\times10^4$ Kg/cm$^2$) and a thermal contraction coefficient of between about $6.7\times10^{-5}$/° C.; and the Young's Modulus of the PEN substrate support was about $5.5\times10^5$ psi ($3.8\times10^4$ Kg/cm$^2$) and a thermal contraction coefficient of $1.8\times10^{-5}$/° C.

Disclosure Imaging Member Preparation Example II

An additional flexible imaging member web was prepared following the same procedures and using identical materials to form all the layers as those described in the preceding Disclosure imaging Member Preparation Example I, except that the plasticized ACBC was further modified to include 5% wt polyterafluoroethylene (PTFE) dispersion (particle size of 0.2 micrometer available as ZONYL MP1000 from E.I. du Pont de Nemours & company) in its layer matrix, based on the resulting weight of the disclosed ACBC. The plasticized and PTFE containing ACBC of such disclosure had optical clarity and gave the resulting imaging member absolute flatness.

Adhesion and Wear Assessments

The three imagine member webs prepared according to the above disclosure of Working Examples were determined for each respective ACBC adhesion bond strength to the substrate and further assessed for the mechanical friction wear resistance against the conventional ACBC in the imaging member web control.

The ACBC adhesion bond strength to the substrate support of the imaging members was carried out by 180° peel strength measurement. Peel measurement test samples were prepared by cutting a minimum of three 0.5 inch (1.2 cm)×6 inches (15.24 cm) imaging member strips from every imaging member web of the four Working Examples. For each test sample strip, the ACBC was partially separated off from one end of the test strip (with the aid of a razor blade) and then hand peeled to give about 3.5 inches from that end to expose the substrate support layer the sample strip. This test sample strip was then secured to a 1 inch (2.54 cm)×6 inches (15.24 cm) and 0.05 inch (0.254 cm) thick aluminum backing plate (having the CTL facing and adhering to the backing plate) with the aid of two sided adhesive tape. The end of the resulting assembly, having the peeled off ACBC, was inserted into the upper jaw of an Instron Tensile Tester. The free end of the partially peeled ACBC was inserted into the lower jaw of the Instron Tensile Tester. The jaws were then activated at a one inch/mm. crosshead speed, a two inch chart speed and a load range of 200 grams, to peel the sample at least two inches at an angle of 180°. The load was calculated to derive the peel strength of the ACBC adhesion to the substrate. The peel strength was determined to be the load required for peeling off the ACBC divided by the width (1.27 cm) of the test sample strip.

For wear resistance assessment, the imaging member webs of all the Working were each again cut to give a size of 1 inch (2.54 cm) by 12 inches (30.48 cm) sample and then assed for resistance to wear of the ACBC. Testing was conducted by means of a dynamic mechanical cycling device in which glass tubes were skidded across the surface of the ACBC on each imaging member. More specifically, one end of the test sample was clamped to a stationary post and the sample was looped upwardly over three equally spaced horizontal glass tubes and then downwardly over a stationary guide tube through a generally inverted "U" shaped path with the free end of the sample secured to a weight which provided one pound per inch width tension on the sample. The outer surface of the imaging member bearing the ACBC was faced downwardly so that it would periodically be brought into sliding mechanical contact with the glass tubes. The glass tubes had a diameter of one inch.

Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated about the shaft, two glass tubes were maintained at all times in sliding contact with the surface of the ACBC. The axis of each glass tube was positioned about 4 cm from the shaft. The direction of movement of the glass tubes along the charge transport layer surface was away from the weighted end of the sample toward the end clamped to the stationary post. Since there were three glass tubes in the test device, each complete rotation of the disk was equivalent to three wear cycles in which the surface of the ACBC was in sliding mechanical contact with a single stationary support tube during the testing. The rotation of the spinning disk was adjusted to provide the equivalent of 11.3 inches (28.7 cm) per second tangential speed. The extent of ACBC wear-off by the sliding contact friction against the glass tubes was measured using a permascope at the end of a 330,000 wear cycles test.

The results obtained for ACBC 180° peel-off strength and wear resistance are listed in Table 2 below:

TABLE 2

| Imaging Member | PTFE in ACBC | Thickness Peel Strength (gms/cm) | Wear Off (microns) |
|---|---|---|---|
| Control | None | 86 | 10.8 |
| Example I | None | 91 | 11.2 |
| Example II | 5% wt | 85 | 1.4 |

Table 2 showed that the electrophotographic imaging member containing a plasticized ACBC with the conventional 4,4'-isopropylidene diphenol polycarbonate (the bisphenol A polycarbonate), PE 2200 adhesion promoter and DEP plasticizer exhibited good adhesion bond strength to the PEN substrate and wear resistance equal to the values obtained for the conventional ACBC of the Control Imaging Member Example. Additionally, the plasticized ACBC prepared to include PTFE particles dispersion into its material matrix provided significant improvement to the ACBC's wear resistance.

It is important to note that flexible imaging member prepared to employ a plasticized CTL require the inclusion of a plasticized ACBC to provide absolute imaging member flatness and render the PEN substrate protection as well to resolve PEN wear/scratch failure problem under dynamic machine imaging member belt cycling condition in the field.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A flexible imaging member comprising:

a substrate;

a charge generating layer disposed on the substrate;

a charge transport layer disposed on the charge generating layer, wherein the charge transport layer comprises a first liquid plasticizer; and an anti-curl back coating disposed on the substrate on a side opposite to the charge transport layer, wherein the anti-curl back coating comprises a polycarbonate, and a second liquid plasticizer.

2. The flexible imaging member of claim 1, wherein the flexible imaging member is substantially flat.

3. A flexible imaging member of claim 2, wherein the flexible imaging member has an upward curling that is equal to or greater than 14 inches in diameter of curvature.

4. The flexible imaging member of claim 1, wherein the polycarbonate is selected from the group consisting of:

Formula A-1

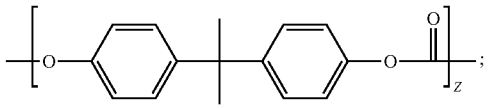

Formula A-2

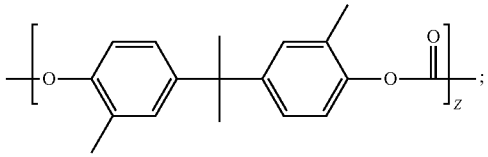

Formula A-3

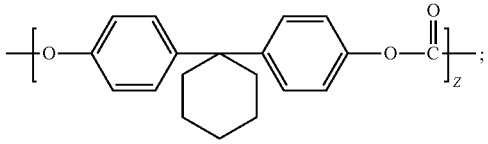

-continued

Formula A-4

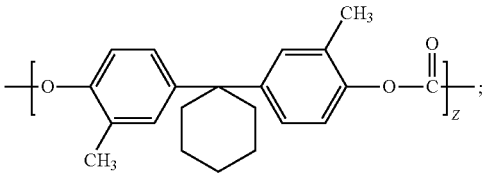

Formula A-5

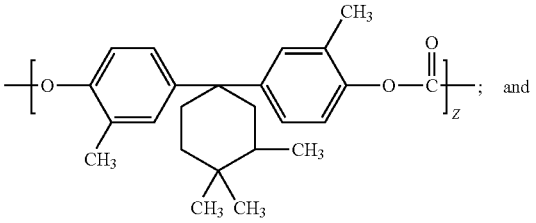

Formula A-6

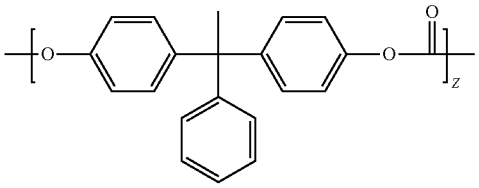

wherein Z is from about 200 to about 1200.

5. The flexible imaging member of claim 1, wherein the polycarbonate has a weight average molecular weight of from about 80,000 to about 250,000.

6. The flexible imaging member of claim 1, wherein the polycarbonate is present in an amount of from about 50 to about 90 percent by weight based on the total weight of the anti-curl back coating.

7. The flexible imaging member of claim 1, wherein the first and second liquid plasticizer have the following formula:

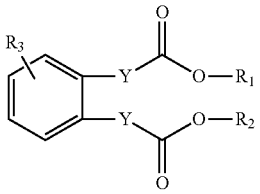

wherein Y is O or null; each $R_1$ and $R_2$ is independently $C_1$-$C_6$ alkyl or $R_1$ and $R_2$ taken together with the O atom of the ester groups to which they are attached and part of the benzene ring form a heterocyclic ring; $R_3$ is H or —C(O)$OR_4$; and $R_4$ is $C_1$-$C_6$ alkyl.

8. The flexible imaging member of claim 1, wherein the first and second liquid plasticizer is a phthalate selected from the group consisting of:

Formula (I)

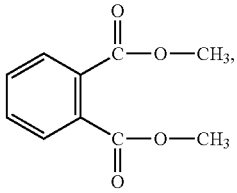

Formula (IA)

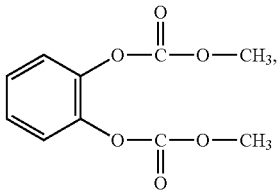

Formula (II)

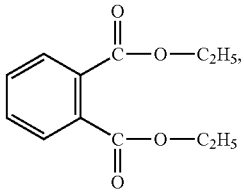

Formula (IIA)

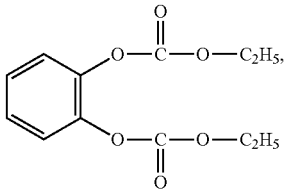

Formula (III)

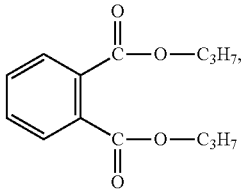

Formula (IV)

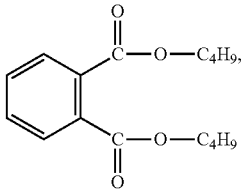

Formula (V)

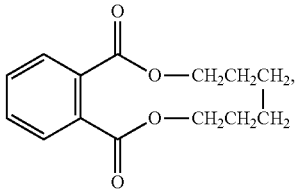

Formula (VI)

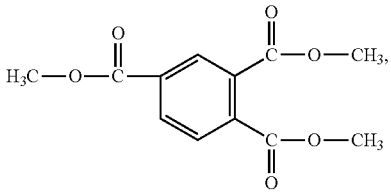

-continued

Formula (VII)

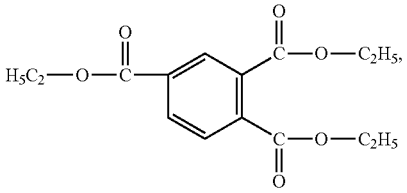

and mixtures thereof.

9. The flexible imaging member of claim 1, wherein the first and second liquid plasticizer is a carbonate selected from the group consisting of Diethylene glycol bis(allyl carbonate)

Formula (6), and mixtures thereof.

10. The flexible imaging member of claim 1, wherein the first and second liquid plasticizer is Formula (B)

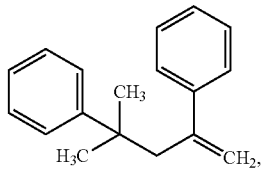

or

Formula (1)

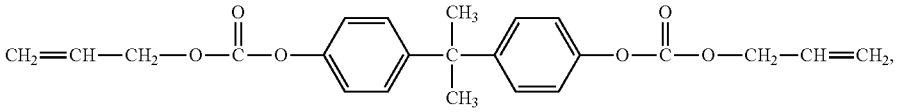

Formula (2)

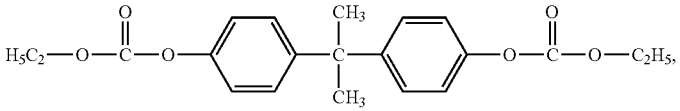

Formula (3)

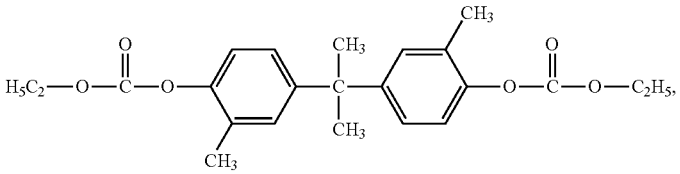

Formula (4)

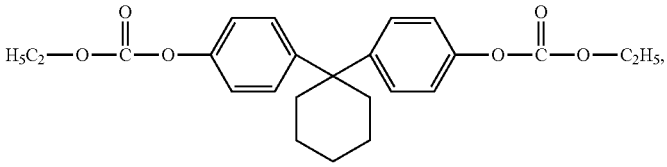

Formula (5)

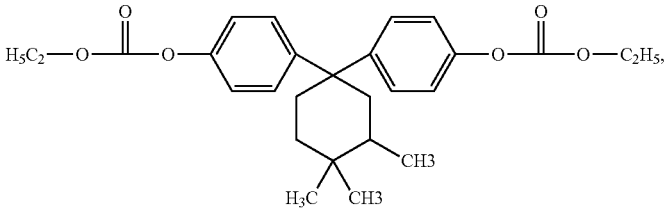

Formula (6)

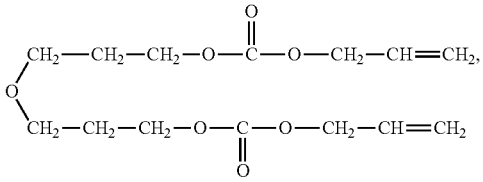

Diethylene glycol bis(allyl carbonate)

-continued

Formula (A)

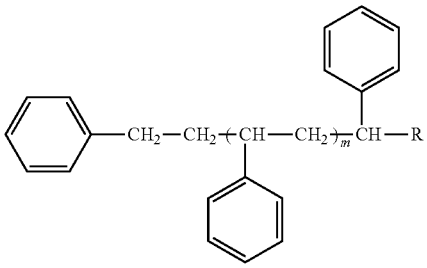

wherein R is selected from the group consisting of H, $CH_3$, $CH_2CH_3$, and $CH{=}CH_2$, and where m is between 0 and 3.

11. The flexible imaging member of claim 1, wherein the first and second liquid plasticizer have the formula:

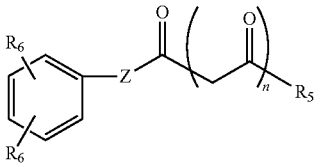

wherein $R_5$ is $C_1$-$C_6$ alkyl, perhaloalkyl, or haloalkyl; Z is null or alkylene; n is 0 or 1; $R_6$ is H, $C_1$-$C_6$ alkoxy, perhaloalkyl, or haloalkyl.

12. The flexible imaging member of claim 1, wherein the first and second liquid plasticizer is a fluoroketone selected from the group consisting of 3-(trifluoromethyl)phenylacetone, 2'-(trifluoromethyl)propiophenone, 2,2,2-trifluoro-2',4'-dimethoxyacetophenone, 3',5'-bis(trifluoromethyl)acetophenone, 3'-(trifluoromethyl)propiophenone, 4'-(trifluoromethyl)propiophenone, 4,4,4-trifluoro-1-phenyl-1,3-butanedione, and 4,4-difluoro-1-phenyl-1,3-butanedione.

13. The flexible imaging member of claim 1, wherein the first and second liquid plasticizer are present in an amount of from about 5 weight percent to about 20 weight percent based on the total weight of the anti-curl back coating.

14. The flexible imaging member of claim 1, wherein the charge transport layer further comprises the same liquid plasticizer and polycarbonate as that in the anti-curl back coating.

15. The flexible imaging member of claim 14, wherein the charge transport layer further comprises a charge transport compound and the liquid plasticizer is miscible with both the polycarbonate and the charge transport compound.

16. The flexible imaging member of claim 1, wherein the anti-curl back coating further comprises a copolyester adhesion promoter.

17. The flexible imaging member of claim 16, wherein the polycarbonate to the copolyester adhesion promoter weight ratio in the anti-curl back coating is from about 80:20 to about 99:1.

18. The flexible imaging member of claim 1, wherein the anti-curl back coating has a thickness of between about 5 micrometers and about 40 micrometers.

19. The flexible imaging member of claim 1, wherein the anti-curl back coating has a thickness of between about 10 micrometers and about 20 micrometers and the charge transport layer has a thickness of between about 15 and 35 micrometers.

20. A flexible imaging member comprising:

a substrate;

a charge generating layer disposed on the substrate;

a charge transport layer disposed on the charge generating layer, wherein the charge transport comprises a first liquid plasticizer; and an anti-curl back coating disposed on the substrate on a side opposite to the charge transport layer, wherein the anti-curl back coating comprises a polycarbonate, a copolyester adhesion promoter, and a second liquid plasticizer having the following formula:

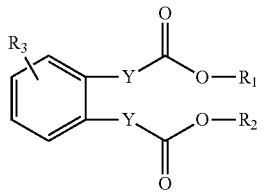

wherein Y is O or null; each $R_1$ and $R_2$ is independently $C_1$-$C_6$ alkyl or $R_1$ and $R_2$ taken together with the O atom of the ester groups to which they are attached and part of the benzene ring form a heterocyclic ring; $R_3$ is H or —C(O)$OR_4$; and $R_4$ is $C_1$-$C_6$ alkyl.

21. The flexible imaging member of claim 20, wherein the first and second liquid plasticizer have a boiling point exceeds 250° C.

22. A substantially flat flexible imaging member comprising:

a substrate;

a charge generating layer disposed on the substrate;

a charge transport layer disposed on the charge generating layer, wherein the charge transport layer comprises a polycarbonate binder, a charge transport compound of N,N'-diphenyl-N,N'-bis(3-methylphenyl)-1,1'-biphenyl-4,4'-diamine, and a first liquid plasticizer; and an anti-curl back coating disposed on the substrate on a side opposite to the charge transport layer, the anti-curl back coating comprises a polycarbonate, a copolyester adhesion promoter, an organic or inorganic particle or mixtures thereof, and a second liquid plasticizer, wherein the substantially flat flexible imaging member exhibits an upward curling of at least equals to or greater than 14 inches in diameter of curvature.

* * * * *